US005470499A

United States Patent [19]

Choy et al.

[11] Patent Number: 5,470,499

[45] Date of Patent: Nov. 28, 1995

[54] THICKENED AQUEOUS ABRASIVE CLEANSER WITH IMPROVED RINSABILITY

[75] Inventors: Clement K. Choy, Alamo; Brian P. Argo, Tracy; Kevin J. Brodbeck, Pleasanton; Lynn M. Hearn, Livermore, all of Calif.

[73] Assignee: The Clorox Company, Oakland, Calif.

[21] Appl. No.: 125,949

[22] Filed: Sep. 23, 1993

[51] Int. Cl.[6] ..... C11D 7/22

[52] U.S. Cl. ..... 252/99

[58] Field of Search ..... 252/99

[56] References Cited

U.S. PATENT DOCUMENTS

| | | | |
|---|---|---|---|
| 3,985,668 | 10/1976 | Hartman | 252/99 |
| 4,005,027 | 1/1977 | Hartman | 252/95 |
| 4,051,056 | 9/1977 | Hartman | 252/99 |
| 4,240,919 | 12/1980 | Chapman | 252/95 |
| 4,284,533 | 8/1981 | Imamura et al. | 252/542 |
| 4,287,079 | 9/1981 | Robinson | 252/99 |
| 4,599,186 | 7/1986 | Choy et al. | 252/102 |
| 4,657,692 | 4/1987 | Choy et al. | 252/99 |
| 4,695,394 | 9/1987 | Choy et al. | 252/102 |
| 4,836,948 | 6/1989 | Corring | 252/99 |
| 4,857,226 | 8/1989 | Drapier et al. | 252/174.25 |
| 4,950,416 | 8/1990 | Baxter | 252/99 |
| 5,130,043 | 7/1992 | Prince et al. | 252/85 |
| 5,185,096 | 2/1993 | Ahmed | 252/99 |
| 5,229,026 | 7/1993 | Dixit | 252/94 |
| 5,260,051 | 11/1993 | Cho | 252/174 |

FOREIGN PATENT DOCUMENTS

| | | |
|---|---|---|
| 345611 | 12/1989 | European Pat. Off. . |
| 373864 | 6/1990 | European Pat. Off. . |
| 446761 | 9/1991 | European Pat. Off. . |
| 541203 | 5/1993 | European Pat. Off. . |
| 560615 | 9/1993 | European Pat. Off. . |

*Primary Examiner*—José G. Dees
*Assistant Examiner*—Joseph M. Conrad, III
*Attorney, Agent, or Firm*—Michael J. Mazza

[57] ABSTRACT

The invention is a hard surface abrasive scouring cleanser having no significant syneresis, undue viscosity or yield stress increase, stably suspends abrasives, and has excellent rinsing characteristics. Furthermore, the present invention provides a stably suspended abrasive scouring cleanser which uses relatively small amounts of surfactants, thus lowering the total cost of producing these cleansers. The lesser amount of surfactant also affords the cleanser a milder feel and lower unaesthetic surfactant odor, while also requiring lower levels of fragrance. The absence of solvents results in a less irritating product as well.

In one aspect the invention comprises, in aqueous solution:
(a) a cross-linked polyacrylate;
(b) at least one nonionic surfactant;
(c) a pH adjusting agent; and
(d) a calcium carbonate abrasive.

In a further aspect the invention comprises, in aqueous solution:
(a) a cross-linked polyacrylate thickener;
(b) a mixed surfactant system which comprises one anionic surfactant and an amine oxide nonionic surfactant;
(c) a pH adjusting agent;
(d) a hydrotrope; and
(e) a particulate abrasive.

16 Claims, 1 Drawing Sheet

THICKENED AQUEOUS ABRASIVE CLEANSER WITH IMPROVED RINSABILITY

BACKGROUND OF THE INVENTION

1. Field of the Invention

This invention relates to a thickened aqueous abrasive scouring cleanser and, in particular, to a thickened aqueous abrasive cleanser having improved phase and viscosity stability and enhanced rinsability.

2. Description of Related Art

In the quest for hard surface cleaners which have efficacy against a variety of soils and stains, various heavy duty liquid cleansers have been developed. As an example, U.S. Pat. Nos. 3,985,668, 4,005,027 and 4,051,056 all issued to Hartman, show a combination of perlite (an expanded silica abrasive), a colloid-forming clay, in combination with a hypochlorite bleach, a surfactant and a buffer in which abrasives are suspended. A clay thickened system of this type tends to set up or harden upon storage due to the false body nature of the thickeners, and requires shaking before use to break down the false body structure. Other prior art cleaners which attempt to suspend abrasives use either inorganic colloid thickeners only, or high levels of mixed surfactant thickeners. Syneresis often becomes a problem as the solids portion of such cleansers substantially separate from the liquids portion. Further, surfactants are costly and may have a detrimental effect on hypochlorite stability. U.S. Pat. No. 4,287,079, issued to Robinson, relates to a clay/silicon dioxide thickened, bleach-containing abrasive cleanser which could contain an anionic surfactant. Chapman, U.S. Pat. No. 4,240,919 describes a liquid abrasive scouring cleanser with a thixotropic rheology and discloses a multivalent stearate soap to provide the thixotropic rheology. Such stearate thickened systems exhibit poor phase stability at temperatures above about 90° F. Gel-like, liquid automatic dishwasher detergents are disclosed in Baxter, U.S. Pat. No. 4,950,416; Drapier et al., U.S. Pat. No. 4,732,409; and EP 345,611 to Delvaux et al. (published Dec. 13, 1989). The compositions of Drapier et al. and Delvaux et al. are clay thickened, phosphate-built thixotropic detergents. The phosphate builder system disclosed by these references is incompatible with a calcium carbonate abrasive. Baxter also discloses $C_{8-22}$ fatty acids or their aluminum, zinc or magnesium salts to increase yield stress and cup retention properties of an automatic dishwashing detergent which is thickened with a colloidal alumina. Like Drapier et al. and Delvaux et al., however, the compositions of Baxter are phosphate based, and do not include an abrasive. While employing colloidal alumina as a thickener, Baxter uses only small amounts of surfactants for their cleaning functionality, thus results in a thixotropic rheology, as compared with the plastic rheology of the formulations herein.

A number of references teach thickening automatic dishwashing compositions with polyacrylates. Finley et al., EP 373,864, and. Prince et al, U.S. Pat. No. 5,130,043, disclose automatic compositions consisting of polyacrylate thickeners, amine oxide detergent and optional fatty acid soap and/or anionic surfactant. Corring, U.S. Pat. No. 4,836,948, employs polyacrylates in combination with colloidal thickeners and high levels of builders. Ahmed, U.S. Pat. No. 5,185,096, also describes a thickened composition employing fatty acids and salts plus a stearate stabilizer and optionally a clay or polyacrylate thickener.

The disclosures of U.S. Pat. Nos. 4,599,186, 4,657,692 and 4,695,394, all to Choy et al., teach the use of an inorganic colloid combined with a surfactant/electrolyte system to provide good physical stability. These patents are commonly owned herewith and are incorporated herein by reference.

In view of the art, there remains a need for improving long-term phase and viscosity stability in thickened liquid abrasive cleansers. Additionally, many of the cleansers of the art exhibit poor rinsability, requiring numerous rinse/sponge cycles to remove the cleanser. There is thus an additional need to significantly improve the rinsability of the cleanser.

SUMMARY OF THE INVENTION

In one aspect of the invention, there is disclosed a thickened liquid abrasive cleanser with enhanced long-term phase and viscosity stability and improved rinsability comprising, in aqueous solution:

(a) a cross-linked polyacrylate;

(b) at least one nonionic surfactant;

(c) a pH adjusting agent; and (d) a calcium carbonate abrasive.

The hard surface abrasive scouring cleansers of the invention provide excellent phase and viscosity stability while suspending abrasive. Additionally, the cleansers of the invention also show substantially no syneresis, even over time and at elevated temperatures, nor do they exhibit a significant change in yield value. Because of the resulting physical stability, the cleansers do not require shaking before use to resuspend solids into a flowable form. The use of the polyacrylate/nonionic surfactant thickener also affords the cleanser improved rinsability.

A further embodiment of the invention provides an aqueous hard surface cleanser without substantial syneresis comprising, in aqueous solution:

(a) a cross-linked polyacrylate;

(b) a mixed surfactant system which comprises at least one anionic surfactant and one nonionic surfactant;

(c) a pH adjusting agent; and (d) a particulate abrasive.

Optionally, oxidants, additional cleaning-effective surfactants, hydrotropes, soaps, fragrances, additional abrasives and solvents may be added to the foregoing embodiments of the cleanser of the present invention.

It is therefore an object of this invention to provide a stable aqueous hard surface abrasive cleanser which has the ability to stably suspend abrasive particles.

It is a further object of this invention to provide a hard surface abrasive cleanser which has substantially no syneresis, and which is stable over time and at elevated temperatures.

It is a further object of the present invention to provide a hard surface abrasive, cleanser which does not increase in viscosity over time, while retaining its desired low yield stress to ensure ease of dispensing.

It is yet another object of this invention to provide an aqueous hard surface abrasive cleanser which does not require shaking before use to facilitate pouring/dispensing.

It is still another object of this invention to provide an aqueous hard surface abrasive cleanser which does not set up or harden over time and therefore remains easily flowable.

It is a further object of this invention to provide an aqueous scouring abrasive cleanser which has demonstrated cleaning efficacy on soap scums, oily soils, and oxidizable, e.g. organic, stains.

It is a further object of the present invention to provide a hard surface cleanser which exhibits improved rinsability.

It is yet another object: of the present invention to provide a thickened product with lower surfactant levels, resulting in a milder feel and less unaesthetic surfactant odor.

In The Drawings FIG. 1 is a graph showing viscosity stability of a formulation of the present invention during six days' storage at 2°, 21°, 38° and 49° C.

DETAILED DESCRIPTION OF THE INVENTION

Figure 1:
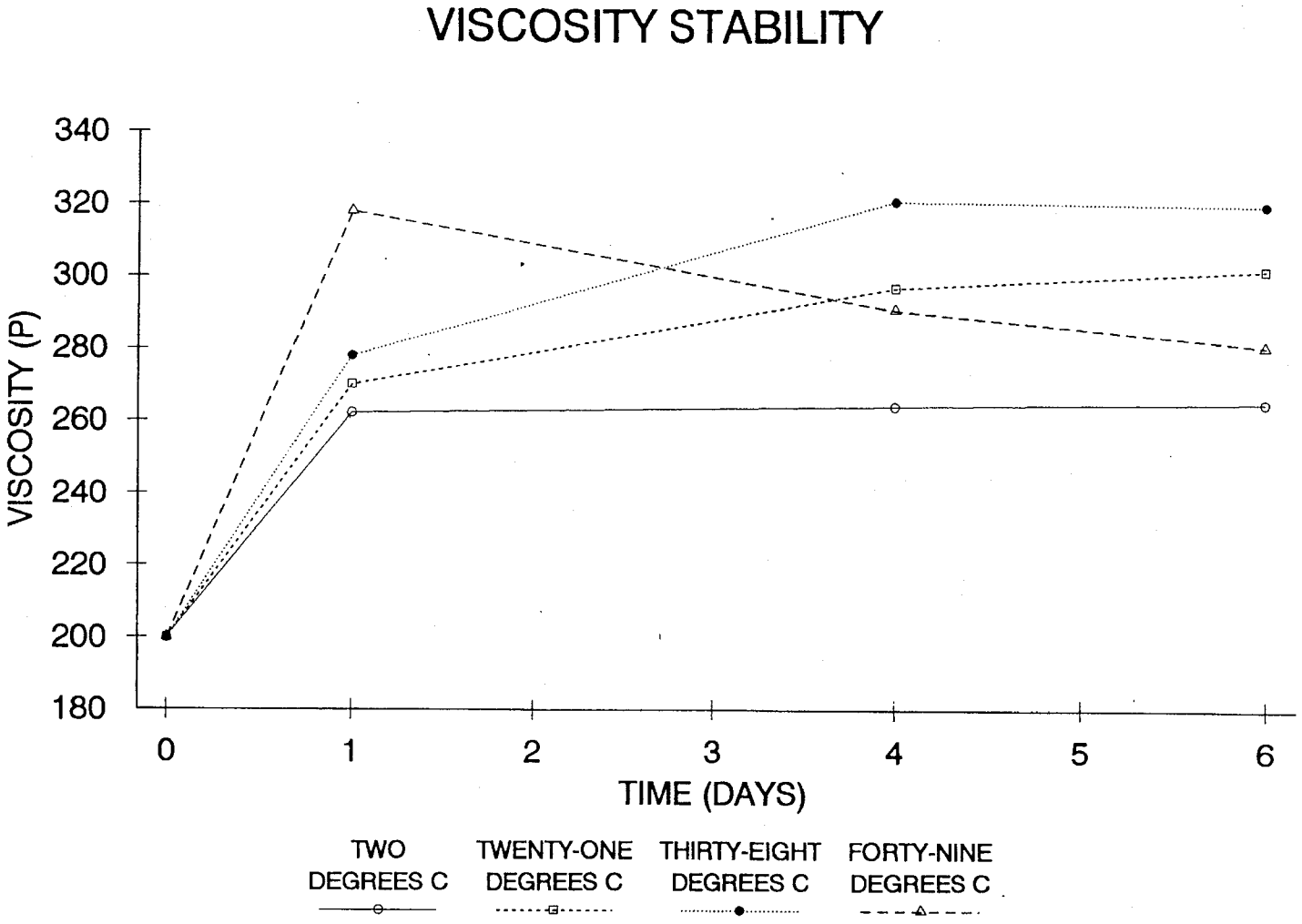

The invention provides a hard surface abrasive scouring cleanser having no significant syneresis, undue viscosity or yield stress value increase, stably suspends abrasives, and has excellent rinsing characteristics. All of the foregoing advantages are present over time and after these compositions have been subjected to storage at elevated temperatures.

Furthermore, as compared to prior art cleaners which include high levels of mixed surfactants, the present invention provides a stably suspended abrasive scouring cleanser which uses relatively small amounts of surfactants, thus lowering the total cost of producing these cleansers. The lesser amount of surfactant also affords the cleanser a milder feel and lower unaesthetic surfactant odor, while also requiring lower levels of fragrance. The absence of solvents results in a less irritating product as well.

In one embodiment, the invention provides a hard surface abrasive scouring cleanser comprising, in aqueous solution:

(a) a cross-linked polyacrylate;

(b) at least one nonionic surfactant;

(c) a pH adjusting agent; and (d) a calcium carbonate abrasive.

A further embodiment of the invention provides an aqueous hard surface cleanser without substantial syneresis comprising, in aqueous solution:

(a) a cross-linked polyacrylate;

(b) a mixed surfactant system which comprises at least one anionic surfactant and at least one nonionic surfactant;

(c) a pH adjusting agent; and (d) a particulate abrasive.

The individual constituents of the inventive cleansers are described more particularly below. As used herein, all percentages are weight percentages of actives, unless otherwise specified. Additionally, the term "effective amount" means an amount sufficient to accomplish the intended purpose, e.g., thickening, suspending, cleaning, etc.

Polyacrylate

The cross-linked polyacrylate polymers of the present invention are generally characterized as resins in the form of acrylic acid polymers. These resins are well known for use in a number of applications and it is commonly theorized that the carboxyl groups in the polymers are responsible for desirable characteristics resulting from the polymers.

Such cross-linked polyacrylate polymers are available from a number of sources including materials available under the trade name CARBOPOL® from B. F. Goodrich Company and under the trade name POLYGEL® available from 3 V Chemical Company. Cross-linked polyacrylate polymers of a type contemplated by the present invention are also believed to be available from other sources which are also contemplated for use within the present invention and as defined herein. The cross-linked polyacrylate polymers are generally characterized as acrylic acid polymers which are non-linear and water-dispersible while being cross-linked with an additional monomer or monomers in order to exhibit a molecular weight in the range from eighty thousand to about seven million g/mole, preferably about one hundred thousand to about seven million g/mole, more preferably about one million to seven million g/mote. Additionally, an average formula weight for a polymer subunit is about 60–120 g/mole, preferably 75–95 g/mole. The most preferred CARBOPOLs average about 86 g/mole. Preferably, the polymers are cross-linked with a polyalkenyl polyether, the cross-linking agents tending to interconnect linear strands of the polymers to form the resulting cross-linked product. The pH of an aqueous polymer solution provides a rough measure of the number of carboxyl groups in the polymer, and thus is an estimate of the degree of cross-linking and/or degree of branching of the polymer. Preferably, the pH of a 2% polymer solution at 21° C. should be between 1.8 and 5.0, more preferably 2.0 and 3.0. The pH is measured before neutralization.

Generally all cross-linked polyacrylate polymers are effective for achieving, in conjunction with the nonionic surfactant, the desired viscosity and stability in compositions of the type contemplated by the present invention. However, some differences particularly in terms of stability have been observed for different crosslinked polyacrylate polymers. Suitable cross-linked polyacrylate polymers for purposes of the present invention include the CARBOPOL 600 series, 900 series, 1300 series and 1600 series resins. Most preferred are the CARBOPOL 1621 and 1610 resins (formerly known as 613 and 623 resins, respectively), which include a cross-linking agent plus hydrophobe. Also suitable is CARBOPOL 672 (formerly 614). More specific examples of polymers selected from these series are included in the examples set forth in the Experimental Section below. Similarly, effective cross-linked polyacrylate polymers for purposes of the present invention also include those available under the trade name POLYGEL and specified as DA, DB, and DK, available from 3 V Chemical Company, and the SOKOLAN® polymers produced by the BASF Corporation.

As is also illustrated by the examples in the following Experimental Section, certain of the cross-linked polyacrylate polymers noted above may provide particular advantages or features within a thickened composition as contemplated by the present invention. Accordingly, it is also contemplated by the present invention to particularly employ mixtures or combinations of such polymers in order to produce compositions exhibiting combined characteristics of the respective polymers.

Generally, the cross-linked polyacrylate polymers of the present invention are believed to be tightly coiled in a presolvated condition with relatively limited thickening capabilities. Upon being dispersed in water, the polymer molecules are hydrated and uncoil or relax to varying degrees. Thickening is particularly effective with the polyacrylate polymers when they are uncoiled or relaxed as noted above. Uncoiling of the polyacrylate polymers may be achieved for example by neutralizing or stabilizing the polymer with inorganic bases such as sodium hydroxide, potassium hydroxide, ammonium hydroxide or low molecular weight amines and alkanolamines. Neutralization or stabilization of the polyacrylate polymers in this manner rapidly results in almost instantaneous thickening of an aqueous solution containing the polymers and nonionic surfactants. It is noted that the highest viscosity occurs when the polymer is completely neutralized; however, it has been empirically determined that elasticity is greater when the polymer is only partially neutralized. For some applications, it may be preferable to enhance elasticity rather than viscosity, for example, to aid in dispensing through restricted orifices, or to improve residence time on non-horizontal surfaces. Elasticity is also important to suspend abrasives, although even when fully neutralized the polymer retains sufficient elasticity for this purpose.

As noted above, the particular effectiveness of the cross-linked polyacrylate polymers in the present invention is believed to be due to a characteristic yield point or yield value. In this regard, it is noted that a typical liquid tends to deform as long as it is subjected to a tensile or shear stress of the type created by dispensing the liquid from a spray-type dispenser or the like. For such a liquid under shear, the rate of deformation or shear rate is generally proportional to the shear stress. This relationship was originally set forth in Newton's Law and a liquid exhibiting such proportional or straight-line characteristics are commonly termed Newtonian liquids.

With respect to thickening, it should be noted that while there are many types of inorganic and organic thickeners, not all will provide the proper type of shear-thinning rheology desired in the invention. Common clays, for instance, will likely lead to a false body rheology, which, at rest, turn very viscous. A thixotropic rheology is also not desirable in this invention since in the thixotropic state, a liquid at rest also thickens dramatically. If the thixotrope has a yield stress value, as typically found in clay-thickened liquid media, the fluid at rest may not re-achieve flowability without shaking or agitation. The nonionic surfactants included in the formulas of this invention are important in achieving the shear-thinning rheology. The polyacrylate/ nonionic surfactant combination can develop viscosities in the range of 20–70,000 centipoise (cP), preferably 1,000–40,000 cP, and most preferably 10,000–30,000 cP.

Surfactants

The most preferred nonionic surfactants are the amine oxides, especially trialkyl amine oxides, as representative below.

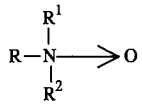

In the structure above, $R^1$ and $R^2$ can be alkyl of 1 to 3 carbon atoms, and are most preferably methyl, and R is alkyl of about 10 to 20 carbon atoms. When $R^1$ and $R^2$ are both methyl and R is alkyl averaging about 12 carbon atoms, the structure for dimethyldodecylamine oxide, a preferred amine oxide, is obtained. Other preferred amine oxides include the $C_{14}$ alkyl (tetradecyl) and $C_{16}$ (hexadecyl) amine oxides. It is particularly preferred to use mixtures of any of the foregoing, especially a mixture of $C_{12}$ and $C_{16}$ dimethyl amine oxide. In general, it has been found that the longer alkyl group results in improved viscosity development and better stability, while the shorter alkyl group appears to contribute to better cleaning performance. Representative examples of these particular type of bleach-stable nonionic surfactants include the dimethyldodecylamine oxides sold under the trademarks AMMONYX® LO and CO by Stepan Chemical. Yet other preferred amine oxides are those sold under the trademark BARLOX® by Lonza, Conco XA sold by Continental Chemical Company, AROMAX™ sold by Akzo, and SCHERCAMOX™ sold by Scher Brothers, Inc. These amine oxides preferably have main alkyl chain groups averaging about 10 to 20 carbon atoms.

Other suitable nonionic surfactants are, for example, polyethoxylated alcohols, ethoxylated alkyl phenols, anhydrosorbitol, and alkoxylated anhydrosorbitol esters. An example of a preferred nonionic surfactant is a polyethoxylated alcohol manufactured and marketed by the Shell Chemical Company under the trademark NEODOL®. Examples of preferred Neodols are Neodol 25-7 which is a mixture of 12 to 15 carbon chain length alcohols with about 7 ethylene oxide groups per molecule; Neodol 23-65, a $C_{12-13}$ mixture with about 6.5 moles of ethylene oxide; Neodol 25-9, a $C_{12-15}$ mixture with about 9 moles of ethylene oxide; and Neodol 45-7, a $C_{14-15}$ mixture with about seven moles of ethylene oxide. Other nonionic surfactants useful in the present invention include a trimethyl nonyl polyethylene glycol ether, manufactured and marketed by Union Carbide Corporation under the Trademark TERGITOL® TMN-6, and an octyl phenoxy polyethoxy ethanol sold by Rohm and Haas under the Trademark TRITON™ X-114. Polyoxyethelene alcohols, such as BRIJ™ 76 and BRIJ 97, trademarked products of Atlas Chemical Co., are also useful. BRIJ 76 is a stearyl alcohol with 10 moles of ethylene oxide per molecule and BRIJ 97 is an oleyl alcohol with 10 moles of ethylene oxide per molecule. Betaines and their derivatives, especially $C_{10-20}$ betaines, are also useful. Particularly preferred are betaines such as those described in the previously mentioned Choy et al. references, the disclosures of which are incorporated herein by reference.

The polyacrylates of the present invention are highly branched and, as described previously, are relatively tightly coiled in a presolvated condition. When dispersed in water, the polymer molecules are hydrated and uncoil to some degree, providing some thickening. However, full viscosity development occurs only when the polymer is neutralized, creating a net negative charge on the carboxyl group. Owing to the proximity of the carboxyl groups, the negatives tend to repel each other, thus greatly increasing the volume occupied by the polymer and resulting in significant thickening. In any system where cations may be present, however, these cations may mitigate the electrostatic repulsion between adjacent anionic carboxyl groups or, in the case of divalent cations, may actually bridge the carboxyl groups, thus recoiling the polymer. Calcium is one such divalent cation which can create such a problem. The use of such cross-linked polyacrylate thickeners in the art has therefore been limited to compositions wherein high levels of calcium, for example calcium carbonate, were not present. It has now been surprisingly found that a polyacrylate can be used as a thickener even in a system containing high levels of a calcium carbonate abrasive by employing the identified nonionic surfactants. It is theorized that the nonionic surfactant affords viscosity stability to the polyacrylate by "surfactant shielding," that is, the positive pole of the nonionic surfactant is attracted to the negatively charged carboxyl groups of the polymer, thus shielding the carboxyl groups from small cationic molecules which would reduce the volume of the polyacrylate. It has been empirically determined that shielding-effective nonionic surfactants have a hydrophobic-lipophobic balance (HLB) of between about 11–13. Most preferred is either an amine oxide, an ethoxylated alcohol, or a mixture of the two. The nonionic surfactant is present in a shielding-effective amount, generally about 0.1 to 10% by weight, more preferably about 0.5 to 3% by weight.

Table 1 shows the effect of an amine oxide and an ethoxylated alcohol surfactant on viscosity stability of a formulation comprising 0.4% CARBOPOL 6 13, 0.6% sodium hydroxide, 30% calcium carbonate, and 0.9% surfactant. The formulations were stored at 49° C., and viscosity was measured periodically.

TABLE 1

Effect of Nonionic Surfactants on Viscosity

| | VISCOSITY[1] (P) | | |
|---|---|---|---|
| Time (Days) | Comparative Example[2] | Amine Oxide | Ethoxylated Alcohol |
| 0 | 400 | 293 | 348 |
| 5 | ppt[3] | 398 | 349 |
| 12 | " | 375 | 349 |
| 20 | " | 398 | NA |
| 24 | " | NA | 370 |
| 34 | " | 450 | 345 |
| 43 | " | 410 | NA |
| 56 | " | 400 | 364 |

[1]Viscosity, in Poise, was measured using a Brookfield RVT rheometer at 21° C., spindle No. 5 at 5 rpm.
[2]Contained water, 40% calcium carbonate, 0.4% CARBOPOL 613, and pH adjusting agent to pH 10.
[3]Polymer precipitated.

It can be seen that the control, lacking a nonionic surfactant, was very unstable and the polymer precipitated after only five days, while both formulations of the present invention (including nonionic surfactant) exhibited excellent viscosity development and stability over time and at an elevated temperature.

Cosurfactants

A cosurfactant may be selected from anionic surfactants such as alkali metal alkyl sulfates, alkyl aryl sulfonates, primary and secondary alkane sulfonates (SAS, also referred to as paraffin sulfonates), alkyl diphenyl ether disulfonates, and mixtures thereof. These anionic surfactants will preferably have alkyl groups averaging about 8 to 20 carbon atoms. Most preferred are alkali metal salts of alkyl aryl sulfonic acids, and especially preferred are linear alkyl benzene sulfonates, known as LAS's. Most preferred are LAS's having $C_{8-16}$ alkyl groups, examples of which include Stepan Chemical Company's BIOSOFT®, and CALSOFT® manufactured by Pilot Chemical Company. Other suitable, though less preferred, anionic cosurfactants include alkali metal alkyl sulfates such as Conco Sulfate WR, sold by Continental Chemical Company, which has an alkyl group of about 16 carbon atoms; and secondary alkane sulfonates such as HOSTAPUR SAS, manufactured by Farbwerke Hoechst A.G., Frankfurt, Germany. Table 2 below is a comparison of various surfactant combinations.

TABLE 2

Surfactant Effects on Initial Viscosity and Stability of Polymer Based Abrasive Cleansers

| | FORMULA | | | | | |
|---|---|---|---|---|---|---|
| | A | B | C | D | E | F |
| Amine Oxide (3:1 LO/CO) wt. % | 0.9 | 0.9 | 0.9 | 0.45 | 0.0 | 0.0 |
| Tergitol TMN-6 (Ethoxylate) wt. % | 0.0 | 0.0 | 0.0 | 0.45 | 0.9 | 0.9 |
| SAS wt. % | 1.7 | 1.7 | 0.0 | 0.0 | 0.0 | 1.7 |
| Sodium Laurate | 0.8 | 0.0 | 0.0 | 0.0 | 0.0 | 0.0 |
| Initial Vicosity[1] | 207 | 132 | 400 | 400 | 420 | 150 |
| Physical Stability | Good | Poor[2] | Good | Good | Good | Poor[2] |

[1]Viscosity, in Poise, was measured using a Brookfield RVT rheometer at 21° C., spindle No. 5 at 5 rpm.
[2]Polymer precipitated.

In addition to the components listed, the formulations of Table 2 also included 0.4% CARBOPOL 6 13, 30% calcium carbonate abrasive, and 0.4% NaOH. It can be seen from Table 2 that a nonionic surfactant (either amine oxide or ethoxylated alcohol) alone yields good viscosity development and results in a stable product. When a secondary alkane sulfonate is included, viscosity development and stability are adversely affected unless a soap is also included.

Determining an appropriate mixture of polyacrylate and nonionic surfactants is very important to the invention. While theoretically anywhere from about 0.01% to 5% polyacrylate can be used, and about 0.1 to 15% surfactants (anionic, nonionic or mixtures thereof), so long as proper rheology and lack of phase separation or syneresis result, in practice it is preferred to use minimal quantities of polyacrylate and surfactants. The amount that is ordinarily used is an amount which is both abrasive-suspending and thickening-effective amount. Applicants have found that preferably about 0.1% to 3%, and most preferably about 0.1% to 1% of polyacrylate, and preferably about 0.25% to 5.0%, most preferably about 0.5% to 3.0% of total surfactant are used in the cleansers of this invention. These ranges appear to result in compositions having the desired syneresis values, ability to suspend abrasives, enhanced rinsability and, because of the reduced amount of actives in the compositions, lower overall manufacturing costs.

pH Adjusting Agent pH adjusting agents may be added to adjust the pH, and/or buffers may act to maintain pH. In this instance, alkaline pH is favored for purposes of both rheology and cleaning effectiveness. Additionally, if the cleanser includes a hypochlorite source, a high pH is important for maintaining hypochlorite stability. Examples of buffers include the alkali metal silicates, metasilicates, polysilicates, carbonates, hydroxides, mono-ethanolamine (MEA) and mixtures of the same. Control of pH may be necessary to maintain the stability of a halogen source and to avoid protonating the amine oxide. For the latter purpose, the pH should be maintained above the pKa of the amine oxide. Thus for the hexadecyl dimethyl amine oxide, the pH should be above about 6. Where the active halogen source is sodium hypochlorite, the pH is maintained above about pH 10.5, preferably above or about pH 12. Most preferred for this purpose are the alkali metal hydroxides, especially sodium hydroxide. The total amount of pH adjusting agent/buffer including that inherently present with bleach plus any added, can vary from about 0.1% to 5%, preferably from about 0.1–1.0%.

Stabilizing Agent

A stabilizing agent may be necessary to maintain viscosity and/or phase stability when certain anionic cosurfactants are present. Preferred stabilizing agents are hydrotropes, which are generally described as non-micelle-forming Substances, either liquid or solids, organic or inorganic, capable of solubilizing insoluble compounds in a liquid medium. As with surfactants, it appears that hydrotropes must interact or associate with both hydrophobic and hydrophilic media. Unlike surfactants, typical hydrotropes do not appear to readily form micelles in aqueous media on their own. In the present invention, it is important that the hydrotrope act as a dispersant and not as a surfactant. Generally, for a formulation of the present invention, a hydrotrope begins to act as a surfactant when the formulation exhibits a drop in phase stability. As a dispersant, the hydrotrope acts to prevent micelle formation by any anionic surfactants present. Similarly, it should be noted that concentration or amount of the material, as well as type, may also be critical towards determining whether such material is a hydrotrope. Thus, materials which ordinarily are classified surfactants may in fact behave as hydrotropes if the amount used is limited. The preferred hydrotropes are alkali metal salts of benzoic acid and its derivatives; alkyl sulfates and sulfonates with 6–10 carbons in the alkyl chain, $C_{8-14}$ dicarboxylic acids, anionic polymers such as polyacrylic acid and their derivatives; and most preferably, unsubstituted and substituted, especially the alkali metal salts of, aryl sulfonates; and unsubstituted and substituted aryl carboxylates. As used herein, aryl includes benzene, napthalene, xylene, cumene and similar aromatic nuclei. Further, "substituted" aryl means that one or more substituents known to those skilled in the art, e.g., halo (chloro, bromo, iodo, fluoro), nitro, or $C_{1-4}$ alkyl or alkoxy, can be present on the aromatic ring. Other good dispersants include other derivatives of aryl sulfonates, salts of phthalic acid and its derivatives and certain phosphate esters. Most preferred are alkyl naphthalene sulfonates (such as Petro 22 available from Petro Chemicals Company) and sodium xylene sulfonate (such as Stepanate X, available from Stepan Chemical Company. Also preferred as stabilizing agents are soaps, especially soluble alkali metal soaps of a fatty acid, such as $C_{6-14}$ fatty acid soaps. Especially preferred are sodium and potassium soaps of lauric and myristic acid. The soap is the preferred stabilizing agent when a secondary alkane sulfonate cosurfactant is employed. When present, sufficient stabilizing agent is added to stabilize, generally 0 to no more than 1% by weight, preferably about 0.1 to 0.5 weight percent. With certain cosurfactant and/or adjunct combinations, it may be preferred to include a mixture of soap and hydrotrope as the stabilizing agent.

Abrasives

Abrasives are used in the invention to promote cleaning action by providing a scouring action when the cleansers of the invention are used on hard surfaces. Abrasives can be present in amounts ranging from about 1% to 70% by weight of the compositions of this invention, preferably about 20–50% by weight. Particle size will range from average particle size of about ten to eight hundred, more preferably forty to six hundred, most preferably fifty to five hundred microns. In general, about 50% or more of the particles will have particle diameters of greater than one hundred microns (pass through U.S. 150 mesh sieves). Particle hardness of the abrasives can range from Mohs hardness of about 2–8, more preferably 3–6. Especially preferred is calcium carbonate, also known as calcite. Calcite is available from numerous commercial sources such as Georgia Marble Company, and has a Mohs hardness of about 3. Typically, a size of U.S. 140 mesh is selected, although others may be appropriate. It is important that the abrasive have the specified small particle size to ensure that little or no thickening occurs with the abrasives. Insoluble inorganic particulate materials can thicken, but such thickening results in a rheology which is not preferable, and thus is to be avoided. Abrasives such as a perlite, silica sand and various other insoluble, inorganic particulate abrasives can also be used, such as quartz, pumice, feldspar, tripoli and calcium phosphate.

Optional Ingredients

The composition of the present invention can be formulated to include such components as fragrances, coloring agents, whiteners, solvents, chelating agents and builders, which enhance performance, stability or aesthetic appeal of the composition. From about 0.01% to about 0.5% of a fragrance such as those commercially available from International Flavors and Fragrance, Inc. may be included in any of the compositions of the first, second or third embodiments. Dyes and pigments may be included in small amounts. Ultramarine Blue (UMB) and copper phthalocyanines are examples of widely used pigments which may be incorporated in the composition of the present invention. Buffer materials, e.g. Carbonates, silicates and polyacrylates also may be added. Oxidants, e.g. bleaches, are preferred for their cleaning activity, and may be selected from various halogen or peroxygen bleaches. Particularly preferred is a halogen bleach source which may be selected from various hypochlorite-producing species, for example, bleaches selected from the group consisting of the alkali metal and alkaline earth salts of hypohalite, haloamines, haloimines, haloimides and haloamides. All of these are believed to produce hypohalous bleaching species in situ. Hypochlorite and compounds producing hypochlorite in aqueous solution are preferred, although hypobromite is also suitable. Representative hypochlorite-producing compounds include sodium, potassium, lithium and calcium hypochlorite, chlorinated trisodium phosphate dodecahydrate, potassium and sodium dicholoroisocyanurate and trichlorocyanuric acid. Organic bleach sources suitable for use include heterocyclic N-bromo and N-chloro imides such as trichlorocyanuric and tribromocyanuric acid, dibromo and dichlorocyanuric acid, and potassium and sodium salts thereof, N-brominated and N-chlorinated succinimide, malonimide, phthalimide and naphthalimide. Also suitable are hydantoins, such as dibromo and dichlorodimethylhydantoin, chlorobromo-dimethylhydantoin, N-chlorosulfamide (haloamide) and chloramine (haloamine). Particularly preferred in this invention is sodium hypochlorite having the chemical formula NaOCl, in an amount ranging from about 0.1 weight percent to about 10 weight percent, more preferably about 0.2% to 5%, and most preferably about 0.5% to 3%.

Under certain conditions, it is important to minimize or avoid the presence of salts, such as sodium chloride, which contribute to ionic strength within the compositions. The hypochlorite would thus preferably be selected or formed in a manner to avoid the presence of such undesirable salts. For example, hypochlorite bleaches are commonly formed by bubbling chlorine gas through liquid sodium hydroxide or corresponding metal hydroxide to result in formation of the corresponding hypochlorite. However, such reactions commonly result in formation of a salt such as sodium chloride.

The present invention thus preferably uses hypochlorites formed for example by reaction of hypochlorous acid with sodium hydroxide or other metal hydroxides in order to produce the corresponding hypochlorite with water as the only substantial by-product. Sodium hypochlorite bleach produced in this manner is referred to as "high purity, high strength" bleach and is available from a number of sources, for example Olin Corporation which produces sodium hypochlorite bleach as a 30% solution in water. The resulting solution is then diluted to produce the hypochlorite composition of the present invention.

The hypochlorite may be formed with other alkaline metals as are well known to those skilled in the art. Although the term "hypochlorite" is employed herein, it is not intended to limit the invention only to the use of chloride compounds but is also intended to include other halides or halites, as discussed in greater detail below. Generally, the present invention preferably uses potassium hypochlorite and sodium hypochlorite produced by the high strength bleach process. To be avoided or minimized is a hypochlorite of any alkali metal including a chloride salt of the corresponding alkali metal. Here again, hypohalites formed with similar alkaline metals are similarly to be minimized. Furthermore, it is especially desirable that the hypochlorite of the invention either avoids the inclusion of a chloride salt as noted above or includes such a chloride salt only within a range of up to about 5% by weight of the composition. As the hypochlorite component is increased from about 1% by weight of the composition, the chloride salt should be even further reduced since the chloride salt, particularly in the presence of the hypochlorite component, makes it difficult to achieve desirable thickening of the composition, or stability.

The hypochlorite and any salt present within the composition are also the principal source of ionic strength for the composition. The ionic strength of the composition has an effect on thickening, that is, if the percentage of salt as noted above is exceeded, it becomes difficult to achieve desirable thickening in the composition. Moreover, high ionic strength may be detrimental to the stability of the composition as it can cause collapse of the polymer structure. In summary, the ionic strength of the compositions of the present invention is maintained preferably less than about 5M, more preferably less than about 3M. It is to be noted, however, that control of ionic strength is an additional avenue by which viscosity and rheology can be controlled, if desired. In general, increasing ionic strength decreases viscosity, but also contributes to a more plastic and less shear-thinning rheology.

Method of Preparing

Addition order is important to developing the desired viscosity and to enable the polyacrylate/nonionic system to maintain the viscosity over time. In the preferred process water, nonionic surfactant, and pH adjusting agent are mixed in a suitable vessel, with stirring. An unthickened alkaline solution results. If an anionic surfactant is to be included, it is added at this initial step. In a separate step, an aqueous slurry of calcium carbonate is made and allowed to degas. To the alkaline solution the calcium carbonate slurry is added slowly with continued mixing. Agitation of the mixture is to be avoided. The solution is allowed to degas, and the polyacrylate is added as an aqueous dispersion. Immediate thickening is observed, and at this point the solution already exhibits good phase stability, as indicated by uniformity of the solution. Adjuncts such as fragrances should be emulsified by the surfactant(s) and added prior to polymer addition. Finally, mixing speed and duration may be adjusted as necessary to incorporate any adjuncts.

EXAMPLE 1

| Ingredient | Wt. % Range |
|---|---|
| Cross-linked polyacrylate | 0.1–2% |
| Nonionic surfactant | 0.1–10% |
| Anionic surfactant | 0–10% |
| pH adjusting agent | 0.1–1% |
| Hydrotrope | 0–1% |
| Abrasive | 5–60% |
| Adjuncts | 0–10% |
| Water | Balance 100% |

EXAMPLE 2

| Ingredient | Wt. % |
|---|---|
| Cross-linked polyacrylate | 0.3 |
| LAS | 1.0 |
| Amine Oxide | 0.5 |
| NaOH | 0.5 |
| $CaCO_3$ abrasive | 40 |
| Adjuncts | 0.2 |
| Water | Balance 100% |

FIG. 1 shows viscosity stability of a formulation made up in accordance with Example 2 above. A sample of the formulation was held for the indicated time and temperatures and viscosities measured using a Brookfield RVT viscometer, using a No. 5 spindle, at 5 rpm and 5° C. Excellent viscosity stability is demonstrated across the range of temperatures.

Table 3 below shows viscosity development and phase stability for formulations made up according to Example 2 but with varying levels of polymer as indicated. It can be seen that using 0.5% amine oxide, good syneresis stability is attained at 0.25 weight percent polymer, or a ratio of polymer:amine oxide of 0.5.

TABLE 3

Effect of Amine Oxide:Polymer on Phase Stability

| Polymer | Polymer: Amine Oxide | Syneresis Stability | Viscosity[1] (P) |
|---|---|---|---|
| .20 | 0.4 | Poor | Unstable |
| .25 | 0.5 | Good | 200 |
| .30 | 0.6 | Good | 250 |
| .35 | 0.7 | Good | 280 |
| .40 | 0.8 | Good | 310 |
| .45 | 0.9 | Good | 350 |

[1]Initial viscosity, in Poise, was measured using a Brookfield RVT rheometer at 21° C., spindle No. 5 at 5 rpm.

Viscosity stability for four different formulations of the present invention is shown in Table 4 below. In this study, two different CARBOPOLs were compared, as were two levels of pH adjusting agents, over time during storage at 49° C. The four formulations were compared to a control comprising a commercially available surfactant thickened abrasive cleanser formulation. It can be seen that the two formulations using the preferred CARBOPOL 613 rapidly developed the highest viscosity and maintained excellent viscosity stability over the duration of the study. The two formulations made up using the less preferred CARBOPOL 614, while developing much higher viscosity than the control, were nonetheless slower to develop the levels of viscosity and did not reach as high a level of viscosity as the preferred CARBOPOL 613. It can also be seen that the two formulations using excess pH adjusting agent developed higher viscosities than the two formulations wherein the pH adjusting agent was added stoichiometrically with the polymer. This shows that complete neutralization of the polymer is necessary to achieve the highest viscosity, and the slight excess appears to be necessary since a portion of the pH adjusting agent reacts with other acidic moieties in the formulation. The formulations of Table 4 included 0.4% polymer, 0.9% nonionic surfactant, 30% calcium carbonate abrasive, 1.1% sodium hypochlorite, 0.8% sodium laurate, 0.8% sodium silicate, 1.7% SAS, 0.5% SXS and the indicated levels of sodium hydroxide (either no excess, or 0.63% excess based on stoichmetric addition of 0.6% for 0.4% polymer). It should be noted that too much excess pH adjusting agent, i.e. too high a pH, can contribute to ionic strength thus can reduce viscosity.

TABLE 4

Effect of Polymer Type and Degree of Neutralization on Viscosity Stability

| | Viscosity[1] (P) Polymer Type/NaOH Level | | | | |
|---|---|---|---|---|---|
| Time (Days) | Control | 613 no excess | 613 excess | 614 no excess | 614 excess |
| 0 | 168 | 204 | 210 | 170 | 168 |
| 4 | NA | NA | NA | 138 | 164 |
| 7 | 188 | 418 | 434 | 152 | 182 |
| 13 | 224 | 434 | 461 | NA | NA |
| 17 | NA | NA | NA | 324 | 370 |
| 24 | 244 | 434 | 461 | 338 | 402 |

[1]Viscosity, in Poise, was measured using a Brookfield RVT rheometer at 21° C., spindle No. 5 at 5 rpm.

Results of a phase stability study are shown in Table 5 below, using the same formulations as in Table 4, except hypochlorite was omitted. Again, it can be seen that the preferred CARBOPOL 6 13 formulation with 0.63% excess sodium hydroxide exhibited no measurable syneresis over the duration of the study.

TABLE 5

Effect of Polymer Type and Degree of Neutralization on Phase Stability

| | Percent Syneresis Polymer Type/NaOH Level | | | | |
|---|---|---|---|---|---|
| Time (Days) | Control | 613 no excess | 613 excess | 614 no excess | 614 excess |
| 0 | 0 | 0 | 0 | 0 | 0 |
| 3 | 4 | 0 | 0 | 1 | 2 |
| 7 | 9 | 3 | 0 | 3 | 7 |
| 10 | 13 | 7 | 0 | 4 | 8 |
| 17 | 16 | 7 | 0 | 4 | 8 |

The effect of a hydrotrope is shown in Table 6 below on a composition comprising 0.4% CARBOPOL 613, 0.9% amine oxide, 30% calcium carbonate abrasive, 0.6% sodium hydroxide, 1.1% sodium hypochlorite, 0.8% sodium laurate, 1.7% SAS, and 0.8% sodium silicate. Formula A omits sodium xylene sulfonate, and Formula B is the same formulation with 0.5% sodium xylene sulfonate. Again, the formulations were made up and held at 49° C. over a period of two weeks with viscosities tested periodically. It is evident that Formula B, with the sodium xylene sulfonate, exhibits excellent viscosity stability compared to Formula A having no sodium xylene sulfonate.

TABLE 6

Effect of Hydrotrope on Viscosity

| | Viscosity[1] (P) | |
|---|---|---|
| Time (Days) | A | B |
| 0 | 244 | 250 |
| 4 | 420 | 216 |
| 8 | 488 | 249 |
| 14 | 190 | 240 |
| 16 | 51 | 200 |

[1]Viscosity, in Poise, was measured using a Brookfield RVT rheometer at 21° C., spindle No. 5 at 5 rpm.

It can be seen that the presence of a hydrotrope in a formulation containing a secondary alkane sulfonate surfactant results in better viscosity stability. It is expected that the viscosity will remain stable over a typical shelf and storage life of the product.

Table 7 below is a polymer screening study showing viscosity development during storage at 49° C. for four polymers. The formulations of FIG. 5 included 0.4% polymer, 1.1% sodium hypochlorite, 30% calcium carbonate, 0.6% sodium hydroxide, and 0.9% nonionic surfactant. Polymer A was CARBOPOL 613; Polymer B was CARBOPOL 614; Polymer C and D were non-cross linked PA 805 and PA 1105, respectively. The control formula was a commercially-available, colloidally-thickened cleanser.

TABLE 7

Effect of Polymer on Viscosity

| | Viscosity[1] (P) | | | | |
|---|---|---|---|---|---|
| Time | | Polymer | | | |
| (Days) | Control | A | B | C | D |
| 0 | 160 | 220 | 180 | 140 | 150 |
| 6 | 159 | 400 | 360 | 160 | 190 |
| 12 | 161 | 680 | 400 | 180 | 240 |
| 20 | 158 | 410 | 300 | 120 | 170 |
| 24 | 164 | 310 | 200 | 110 | 130 |

[1]Viscosity, in Poise, was measured using a Brookfield RVT rheometer at 2° C., spindle No. 5 at 5 rpm.

Table 7 demonstrates the superior viscosity development of the cross-linked CARBOPOL 613 and 614 polymers "A" and "B" respectively. The non-cross-linked PA products did not develop significant viscosity compared to the control formulation.

Performance Evaluation

A rinsing performance test was conducted to evaluate rinsability of the formulation of the present invention. In the test, two inches wide of the material was deposited onto a black ceramic tile substrate, set at a 45-degree angle, to form a 350 micron film. Immediately thereafter, rinse water was directed onto the material, at flow rate of 2.4 l/min. through an orifice having an 8×2 mm. nozzle. Rinse time was evaluated by visually determining when all material had been removed. The formulation tested was as shown in Example 2. A commercially available surfactant thickened cleanser was used as a control. Four replicates of each cleanser were tested. Average rinse time for the cleanser of the present invention was twenty-eight seconds, compared to an average of one hundred and eighteen seconds for the control. When scouring a test surface with a sponge, little or no foam residue was observed on the surface after rinsing, and only minimal foam residue remained on the sponge.

Cleaning performance results show that the enhanced viscosity stability afforded by the formulation of the present invention does not significantly degrade cleaning performance compared to a surfactant-thickened control.

Review of the foregoing experimental data shows that the compositions of the invention have good viscosity and phase stability and maintain this advantageous feature over extended times and at elevated temperatures. Concurrently with these rheological advantages the cleaning performance of the formulation of the present invention is at least as good as any of the leading commercial products, over a wide range of soils.

The above examples have been depicted solely for purposes of exemplification and are not intended to restrict the scope or embodiments of the invention. The invention is further illustrated with reference to the claims which follow hereto.

What is claimed is:

1. A thickened liquid abrasive cleanser with enhanced phase and viscosity stability comprising, in aqueous solution:

(a) a cross-linked polyacrylate having a molecular weight of 80,000–7,000,000 g/mole and a pH of a 2% solution at 21° C. of between 1.8 and 5;

(b) at least one nonionic surfactant;

(c) a pH adjusting agent for maintaining the pH at least above a pKa of the nonionic surfactant;

(d) a calcium carbonate abrasive; and wherein the resulting composition is shear-thinning and has an ionic strength of less than about 5M.

2. The cleanser of claim 1 wherein:

the nonionic surfactant is an amine oxide, an alkoxylated alcohol, or a mixture thereof.

3. The cleanser of claim 2 wherein:

the amine oxide is a $C_{14-16}$ dimethyl amine oxide.

4. The cleanser of claim 1 wherein:

the pH adjusting agent is an alkali-metal hydroxide.

5. The cleanser of claim 1 wherein:

the abrasive has an average particle size of about ten to eight hundred microns.

6. The cleanser of claim 1 and further including:

a cosurfactant selected from the group consisting of linear alkylaryl sulfonates;

secondary alkane sulfonates and mixtures thereof.

7. The cleanser of claim 1 and further including:

a stabilizing agent selected from the group consisting of soaps, hydrotropes, and mixtures thereof.

8. The cleaner of claim 1 wherein the composition has a viscosity of less than about 70,000 cP.

9. An aqueous hard surface cleanser without substantial syneresis comprising, in aqueous solution:

(a) a cross-linked polyacrylate thickener having a molecular weight of 80,000–7,000,000 g/mole and a pH of a 2% solution at 21° C. of between 1.8 and 5;

(b) a mixed surfactant system which comprises at least one anionic surfactant and at least one nonionic surfactant;

(c) a pH adjusting agent for maintaining the pH at least above a pKa of the nonionic surfactant;

(d) a particulate abrasive; and wherein the resulting composition is shear-thinning and has an ionic strength of less than about 5M.

10. The cleanser of claim 9 wherein:

the nonionic surfactant is an amine oxide, an alkoxylated alcohol, or a mixture thereof.

11. The cleanser of claim 10 wherein:

the amine oxide is a $C_{14-16}$ dimethyl amine oxide.

12. The cleanser of claim 9 wherein:

the pH adjusting agent is an alkali-metal hydroxide.

13. The cleanser of claim 9 wherein:

the particulate abrasive is calcium carbonate.

14. The cleanser of claim 9 and further including:

a cosurfactant selected from the group consisting of linear alkylaryl sulfonates;

secondary alkane sulfonates and mixtures thereof.

15. The cleanser of claim 9 and further including:

a stabilizing agent selected from the, group consisting of soaps, hydrotropes, and mixtures thereof.

16. The cleanser of claim 9 wherein the composition has a viscosity of less than about 70,000 cP.

* * * * *